United States Patent [19]

Kullander

[11] 4,257,343

[45] Mar. 24, 1981

[54] COATING APPARATUS WITH VACUUM BIASED DOCTOR BLADE

[75] Inventor: Mats O. Kullander, Säffle, Sweden

[73] Assignee: Billeruds Aktiebolag, Säffle, Sweden

[21] Appl. No.: 7,636

[22] Filed: Jan. 29, 1979

Related U.S. Application Data

[62] Division of Ser. No. 523,051, Nov. 12, 1974, abandoned.

[30] Foreign Application Priority Data

Nov. 16, 1973 [SE] Sweden ..... 7315528
Aug. 2, 1974 [SE] Sweden ..... 7409968

[51] Int. Cl.[3] ..... B05C 3/12; B05C 11/04; B05C 11/10

[52] U.S. Cl. ..... 118/50; 118/126; 118/413

[58] Field of Search ..... 118/50, 126, 413, 50.1, 118/415; 427/294–298, 350, 356–358

[56] References Cited

U.S. PATENT DOCUMENTS

| | | | |
|---|---|---|---|
| 2,257,373 | 9/1941 | Fanselow | 427/356 X |
| 2,354,033 | 7/1944 | McGladrey et al. | 118/50 X |
| 3,192,895 | 7/1965 | Galer | 427/356 X |
| 3,335,701 | 8/1967 | Verkinderen et al. | 118/126 |
| 3,461,837 | 8/1969 | Dreher | 118/50 |
| 3,486,482 | 12/1969 | Hunger | 118/413 |
| 3,502,494 | 3/1970 | Ishiwata et al. | 427/358 |
| 3,690,917 | 9/1972 | Herzhoff et al. | 118/50 X |
| 3,695,218 | 10/1972 | Herzhoff et al. | 118/50 |
| 3,722,465 | 3/1973 | Krautzberger | 118/413 X |

*Primary Examiner*—Morris Kaplan
*Attorney, Agent, or Firm*—Toren, McGeady and Stanger

[57] ABSTRACT

In coating a strip of material, such as web of paper, it is passed over a support member forming one of the enclosing surfaces of a closed chamber. The closed chamber is arranged to operate under vacuum conditions. Coating liquid is supplied in excess to the closed chamber to form a layer on the surface of the strip. At the end of the coating action, as the strip leaves the closed chamber, it is contacted by a movably positionable blade which provides a wiping-off action on the strip so as to remove the excess of coating liquid from the strip. The vacuum inside the closed chamber urges the blade against the strip. Therefore, it is possible, by varying the vacuum, to vary the amount of coating liquid adhering to the strip leaving the closed chamber.

12 Claims, 4 Drawing Figures

37
18
19
1
2
5
9
5'
4
44
12
8
14
3'
3
38
10
17
7
6
11
20
21
23
16
15
22

COATING APPARATUS WITH VACUUM BIASED DOCTOR BLADE

This is a division of application Ser. No. 523,051 filed Nov. 12, 1974, now abandoned.

SUMMARY OF THE INVENTION

The present invention is directed to apparatus for blade coating a liquid on a moving web and, more particularly, it is directed to the passage of the web through a closed chamber where the blades define the entrance and exit for the strip into and out of the closed chamber.

A moving web or strip of material can be coated with liquid in various ways and by different apparatus depending on the quantity and uniformity of the coating desired and the properties of the web or of the coating liquid. Accordingly, it is feasible to use coating blades or brush rollers, air brushes, presses and the like. The apparatus used is generally open for affording easy accessability for cleaning the apparatus or for rearranging the apparatus after a web rupture, however, under such conditions the liquid can easily spread to parts of the apparatus where it is not wanted and it is easily polluted. Occasionally closed systems are used under pressure so that viscous liquids can be pressed against the web, but even such a coating method leads to spreading of the liquid and to other drawbacks. Blade coating, which is probably the most economical method and which is used for paper when high quality and capacity are required, is substantially limited to coating with mixtures having high viscosity, often demanding great accuracy as to consistency and concentration. In such coating operations it is important that the shape of the blade, its stiffness and its contact with the web are carefully adjusted to the existing conditions, and such adjustment is often difficult to maintain. It is particularly important that a uniform contact is provided over the entire width of the web. Uneven coating across the width of the web or scratching are easily caused, for example, by uneven stiffness of the blade, uneven load-application on the blade, by a thickening of the mixture, or by the presence of impurities.

Accordingly, the primary object of the present invention is to provide apparatus for extending the field of blade coating and to reduce the drawbacks experienced in the past. In the coating operation, the liquid is permitted to flow against or contact the web between two laterally positioned end pieces and between two blades extending transversely of the end pieces and which are freely movable against the end pieces, with one of the blades providing a wiping-on action and the other a wiping-off action. The advantages gained in using the present invention have been surprisingly great, as will be noted from the examples set forth in the following description.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
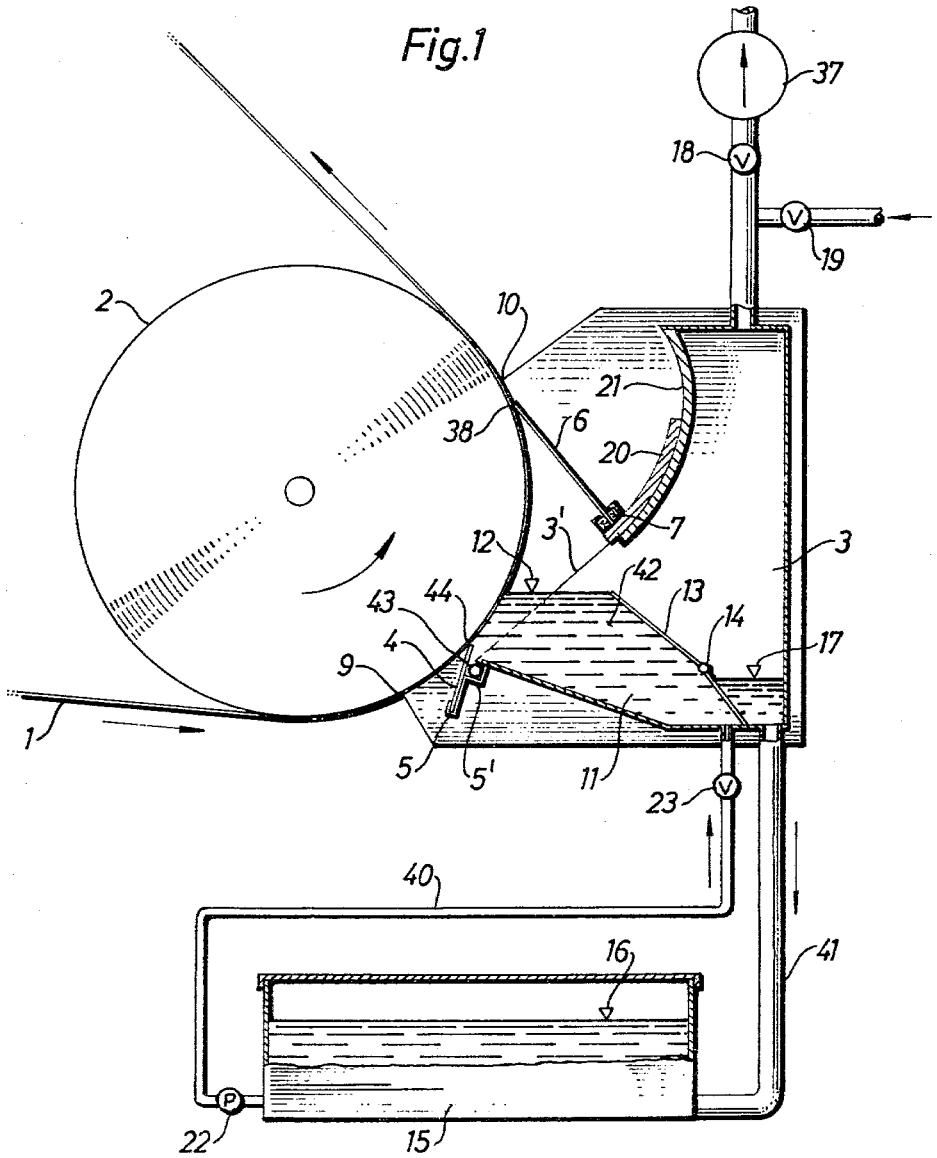
FIG. 1 is a schematic illustration of a coating apparatus embodying the present invention.

In the drawing four different embodiments are shown in which a paper web is introduced into a closed chamber where it is coated with a liquid as it passes between two spaced blades one located at the entrace to the closed chamber and the other located at the exit. Similar parts in the four embodiments are designated with the same reference numerals. Further, four examples are provided based on laboratory experiments carried out using the apparatus illustrated in FIG. 1.

In FIG. 1, as indicated by the arrows, a paper web 1 passes over a roller 2 having a polished surface and for a portion of its passage over the roller the web moves upwardly through a body 42 of coating liquid. After the web passes above the liquid level 12 any excess liquid on the web is wiped off. In forming the receptacle for the coating liquid, a box 3 is positioned adjacent the circumferential periphery of the roller and a pair of spaced blades 4–5 and 6–7 are mounted within the box so that the front edges 4,6 of the blades contact the web. The lateral surfaces or sides of the box 3 have fixed end pieces forming edge $3^1$ facing toward but spaced from the circumferential periphery of the roller 2. The attachment points 5, 7 of the blades 4–5, 6–7 are located on the fixed edge $3^1$. In addition the sides of the box include movable, lockable, flat, sealing end pieces 8 against which the side edges of the blades can move freely. The sealing end pieces have circular sections extending between the spaced points 9, 10 which contact the paper web 1 passing over the roller and the circular sections 9–10 are sealed by a strip of rubber at the contact surface with the paper web. As a result, the box 3 in combination with the circumferential periphery of the roller 2 forms a closed chamber into which the coating liquid is charged. The box 3 forms an opening to the closed chamber defined by the front edges 4, 6 of the blades 4–5, 6–7 and the edges 9–10 of the movable end or side pieces of the box. This opening is closed by the circumferential periphery of the roller 2 which provides a support member for the paper web 1 which moves across the opening between the blades.

The coating liquid is pumped into the lower part 11 of the closed chamber to a level 12. The height of the level is adjusted by a spillway 13 which is movable at joint 14. The joint 14 is shown by way of example, since the height of the spillway 13 can be adjusted in a number of other ways which are well known. As the coating liquid rises to the top of the spillway 13 it flows downwardly to the right of the spillway as viewed in FIG. 1, where it forms a level 17. The liquid is stored in a reservoir 15 and flows into the closed chamber between the spillway 13 and the roller 2 and returns to the reservoir from the space within the box having the level 17. The level 16 within the reservoir 15 is at ambient pressure. However, the pressure within the closed chamber at the liquid levels 12 and 17 is regulated by a suitable balance between the vacuum line 18 and the pressure line 19.

To regulate the angle of the blade 6–7 which provides a wiping off action, the blade attachment point 7 is secured to a part 20 having the shape of a circular arc which is movably supported on a base 21 attached to the box 3 which has a complementary circular arcuate shape. Although not shown, the box is fixed to a stand so that its position in contact with the web can be adjusted, that is, so that the box can be moved toward or away from the web. The stand and the box afford a stable arrangement so that the vacuum developed within the closed chamber in the box does not affect its position.

In carrying out the coating operation, the blade 6–7 acts as a wiping-off blade. The positions and pressure acting on the blades can be roughly set by moving the box 3 toward or away from the web/roller while it slides between the loosened end or side pieces 8. Otherwise, the blades will function and be regulated differently.

The blade 4–5 smooths, evens out and compresses the web. This blade should also balance the pressure from the liquid and the vacuum. However, no work is performed on the liquid. As a result, the torque on the blade 4–5 developed at attachment point 5 would be reasonable. Furthermore, the torque can be easily adjusted uniformly across the width of the web and, as shown in FIG. 1, a channel 5[1] is provided containing a tube 43 in which the pressure is regulated for exerting a uniform torque on the blade. The channel with the tube could also be located at point 5.

The wiping-off blade 6–7 smooths the coating while wiping off any excess liquid at a location spaced above the liquid level 12 in the closed chamber. In the performance of its task on the coating liquid, the blade may create some resistance at high speeds of the web and high viscosity of the liquid. The necessary high pressure at the front edge 38 of the blade is, in this case, attained by the adjustment of the vacuum conditions within the closed chamber. The blade must of course be stiff enough so that the vacuum conditions within the closed chamber is converted to pressure at the front edge 38 of the blade so that the angle at that location would be suitable. However, no torque is provided at attachment point 7 to effect the contact of the blade 6–7 at its front edge 38. As a result, the blade may be relatively thin and flexible and the considerable forces are applied only by the vacuum conditions within the chamber which can be adjusted with great accuracy and can be automatically distributed uniformly across the width of the web.

At the commencement of the coating process, the box 3 is roughly fitted against the web 1/ roller 2. A vacuum pump 37 is connected to the vacuum line 18. A pump 22 is positioned in the supply line 40 extending between the reservoir 15 and the lower part 11 of the closed chamber for charging the coating liquid into the box and the rate at which the liquid is supplied is regulated by a valve 23 in the line 40. As mentioned above, the liquid level 12 within the closed chamber is regulated by the position of the upper end of the spillway 13. The pressure at the front edge 44 of the blade 4–5 is adjusted by means of the hydraulic pressure in the tube 43 located in the channel 5[1]. At the front edge 38 of the wiping-off blade 6–7, the pressure is regulated by the valved vacuum line 18 and the similarly valved supply line 19 which is regulated to reduce the vacuum, as required. The angle of the wiping-off blade relative to the paper web 1 at its front edge 38 is accurately adjusted by moving its attachment point 7 secured to the movable part 20. During the rough adjustment of the box described above, it is normally positioned so that the front edge 38 of the wiping-off blade just reaches the web. Therefore, the position of the front edge 38 remains unchanged even if the angle of the blade to the paper web is altered by moving the attachment point 7. If the apparatus depicted is run at a high vacuum and the blade is so thin that it becomes bent, the rough adjustment can be readjusted taking into consideration the shorter distance between the front edge 38 and the attachment point 7. However, during normal operating conditions using blades of normal stiffness, this readjustment is unnecessary.

When coating is to be discontinued, the pump 22 and the vacuum pump 37 are switched off and the box can be emptied of liquid. Further, if desired, the box can be pulled away from the circumferential surface of the roller. The procedure is the same if a breakage occurs in the web after the coating has been completed. The same procedure can be carried out if the web breaks before reaching the coating apparatus, however, in such a case the pumps should preferably be stopped automatically. The box is suitably cleaned with the help of a permanently fitted spray damper. Necessary cleaning can often be performed without pulling the box away from the roller, that is, it can be performed virtually without any interruption in operation.

Figure 2:
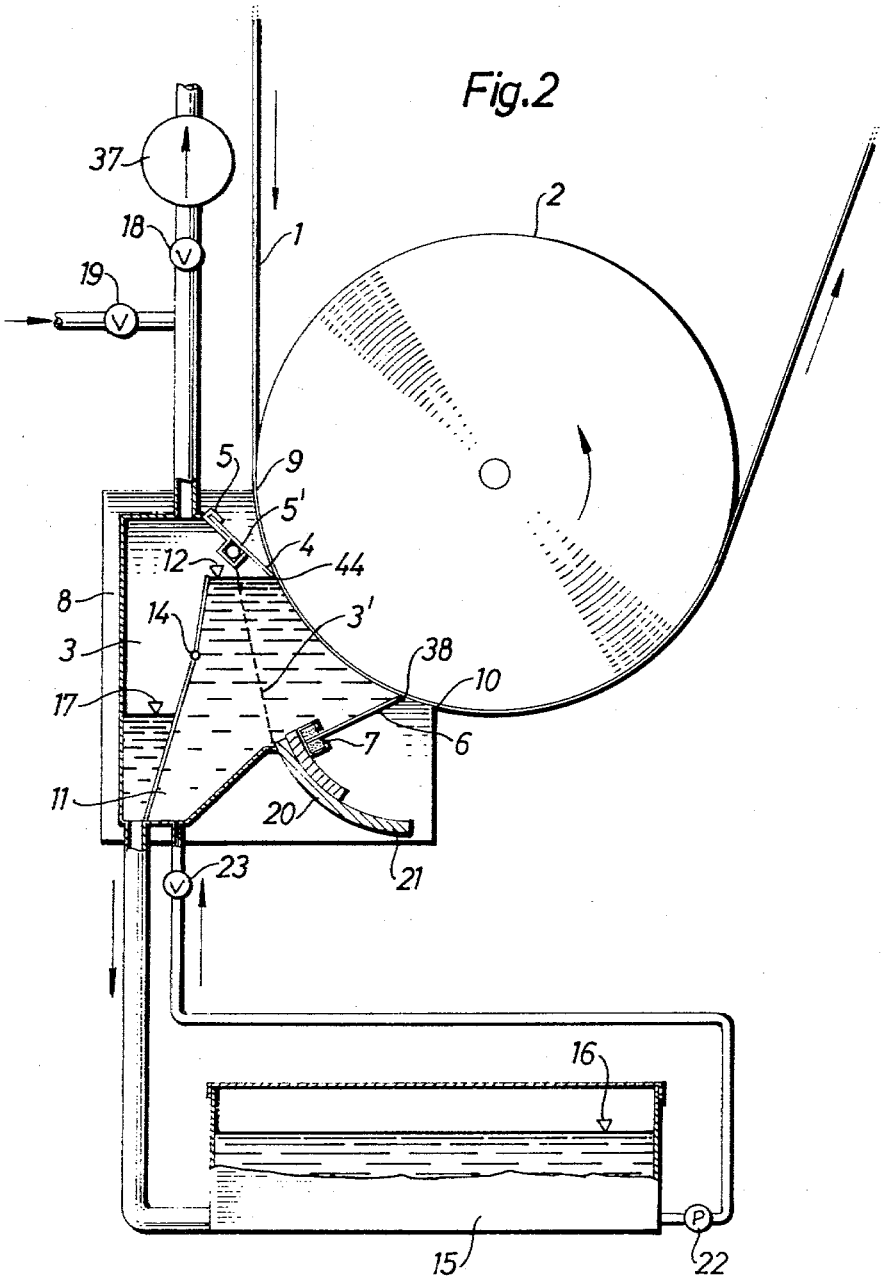
FIG. 2 is a schematic view, similar to FIG. 1, showing a coating apparatus illustrating another embodiment of the present invention.
Figure 3:
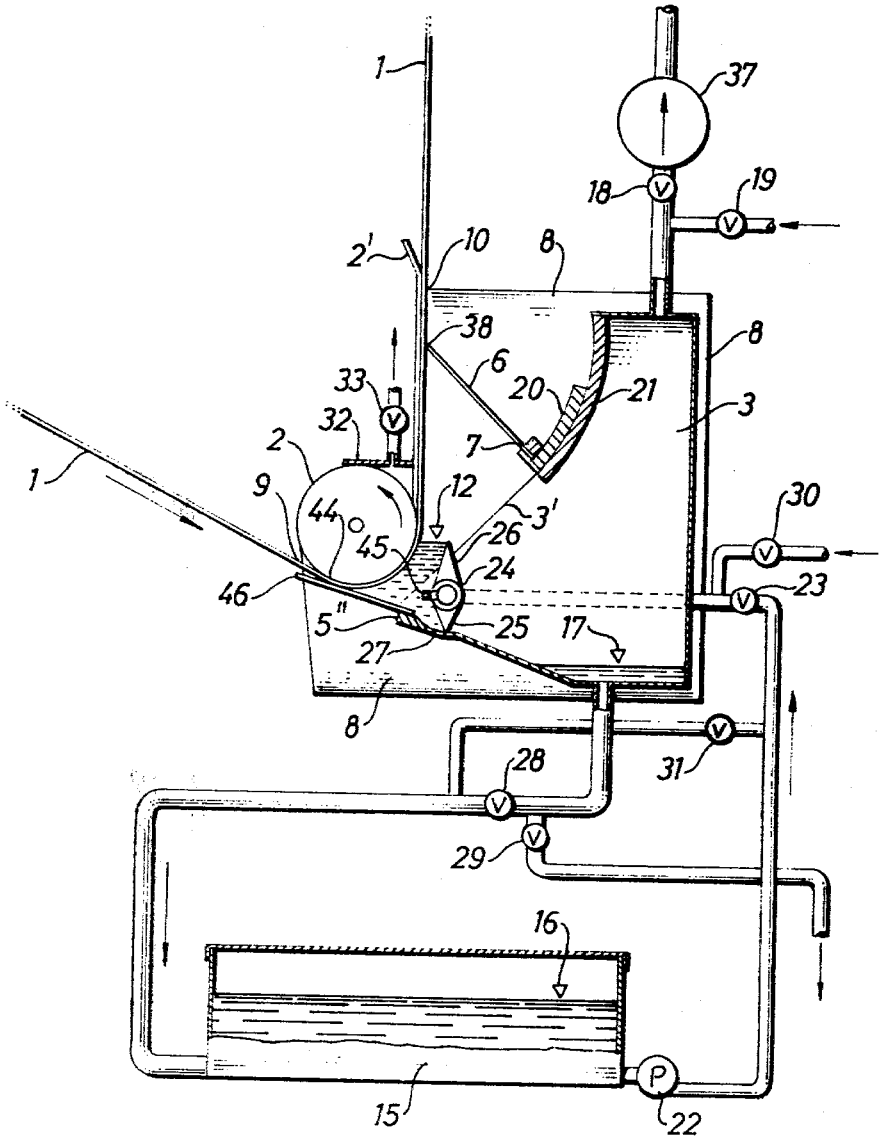
FIG. 3 is another schematic view, similar to FIGS. 1 and 2, displaying a coating apparatus with yet another embodiment of the present invention.

In FIG. 2 the positions of the blades have been reversed so that the web contacts the blade 4–5 approximately at the liquid level 12, and moves downwardly in contact with the liquid until it reaches the wiping-off blade 6–7 at the point at which it exits from the closed chamber within the box. This particular arrangement is desirable, if the coating liquid is sensitive to air. The box can be located in several positions around the periphery of the roller and in FIG. 2 it is shown with the box extending downwardly below the lowermost part of the roller. In this arrangement the wiping-off blade 6–7 is maintained completely below the level 12 of the liquid. Further, by the suitable positioning of the spillway 13 the level 12 can be generally maintained above the edge 44 of the wiping-on blade 4–5. Otherwise for starting, stopping and any breakdowns in the apparatus, it will function in the manner described with respect to FIG. 1. In FIG. 3 another embodiment of the invention is shown with some significant differences in the arrangement for the supplying of the coating liquid in the closed chamber and for the contact of the wiping-off blade with the web.

A strip of material or web 1 moving in the direction of the arrows passes over a solid support or roller 2 so that the portion of the roller over which the web passes is located in the range of an open side of the box 3. At the commencement of the coating operation the web 1 passes between the roller 2 and the contact point 44 of the blade 4–5 and at the end of the coating operation the web passes between the front edge 38 of the wiping-off blade 6–7 and a slip plate 2[1]. The end pieces 8 movably positionable on the sides of the box, are sealed to the box with the blades arranged in the same manner as described with respect to FIG. 1. Accordingly, the end pieces 8 contact the web or the surface of the roller 2 and the slip plate 2[1]. The arrangement of the end pieces 8, the blades 4–5, 6–7, and the roller 2 and slip plate 2[1] provide a closed chamber through which the web 1 passes during the coating operation. Within the closed chamber a pocket 11 is provided in which the coating liquid is maintained at a level 12. The coating liquid is supplied from a source or reservoir 15 having its liquid level 16 at atmospheric pressure and the liquid returns to the reservoir from the supply which has a liquid level 17 within the box. The closed chamber within the box is maintained at vacuum conditions corresponding to the levels 17, 16 by means of the valved vacuum line 18. The partial vacuum within the closed chamber is accurately adjusted by the valved pressure line 19. As shown in FIG. 1, the wiping-off blade 6–7 is attached to a support part 20 having the configuration of a circular arc and the part is mounted on a base 21 having a complementary configuration. The liquid is supplied from the reservoir 15 by a pump 22 through a supply line with the flow being regulated by the valve 23.

As distinguished from the apparatus shown in FIGS. 1 and 2 where the coating liquid flows into the lower part 11 of the closed chamber, in FIG. 3 the supply line from the reservoir 15 is connected to a pivotally mounted spreader pipe 24 which forms one side of the space in the closed chamber within which the coating liquid is maintained in contact with the web passing over the roller 2. The pipe 24 has a pair of flanges 25, 26, with the flange 25 directed downwardly and the flange 26 directed upwardly so that its edge spaced outwardly from the pipe forms the top of the spillway defining the level 12 over which the liquid flows into the space having the liquid level 17. By pivoting the pipe 24 its lower flange 25 can be seated in sealing relation with a shaped part 27 in the bottom of the box 3 so that the body of liquid is retained in the lower part or space 11 where it extends upwardly to the level 12 defined by the upper edge of the flange 26. Holes or slots 45 are provided in the spreader pipe opening into the lower part 11 when the flange 25 is in the generally vertical and sealing position. If the spreader pipe is pivoted from the sealing position of the flange 25 with the part 27 of the box, the pocket will be emptied, and if the supply to the valve 23 is cut off and the partial vacuum reduced, the box can be completely emptied. With the valve 28 in the discharge line from the box 3 to the reservoir 15 closed and the valve 29 in the branch line from the discharge line opened, the inside of the box can be washed. This can be done by opening valve 30 in another branch line connected to the supply line at a point downstream from the valve 23 for supplying the cleaning liquid to the spreader pipe 24 which can be turned manually or by a motor with programmed movement. During the washing operation, the mixture can be permitted to circulate outside the box 3 through the pump 22 and a pressure-regulated valve 31 located in a line extending between the supply line and the discharge line. After washing, the coating operation is commenced by closing the cleaning liquid valves 30, 29, opening the coating liquid valves 28, 23 and moving or pivoting the spreader pipe 24 to the sealing position of its flange 25 with the part 27 of the box.

If the smoothing and pressing blade were positioned with its front edge extending in the direction of travel of the web 1 it would have to be pressed by special means against the web and it would be difficult to avoid pockets developing which are difficult to clean. What might be even worse would be the possibility of thickened patches of the coating liquid forming along the front edge of the blade, which could easily occur. Such patches would hang like curtains over the web and prevent the supply of the coating liquid, or they would fall off. The disturbance caused by such an occurrence can be reduced by inserting the blade so that its front edge 46 faces in the direction opposite to the direction of travel of the web so that the thicknesses in the coating liquid are fed in on the blade, that is, down in the bottom of the trough, from where they can be easily removed in a suitable manner if necessary. The partial vacuum developed within the closed chamber forces the blade against the web with a pressure which is roughly determined by the distance between the contact point 44 of the blade and its attachment point 5'' on the box. Admittedly, it is somewhat more difficult with the oppositely directed blade to obtain a steep drop between the contact point 44 and the attachment point 5'' and a small volume for the space 11 containing the liquid. However, this disadvantage is slight if the solid support 2 is formed by the combination of a rotating roller 2 having a small radius and a slip plate $2^1$ located with one edge adjacent the roller and its other edge spaced upwardly above the roller. As can be seen in FIG. 3, the slip plate $2^1$ extends generally tangentially and upwardly from the roller 2. To prevent the web 1 from being pressed into the box at the point between the roller and the slip plate, the joint may be screened off by a sealing sheet 32 with the space defined between the sealing sheet, the roller and the slip plate connected to a valved vacuum line 33 so that adequate vacuum conditions are maintained.

When the coating paper has irregularities, such as bark particles, it has been found advantageous to use a fixed slip plate having a trough across the web below the front edge 6 of the wiping-off blade 6–7. The web is passed stretched over the trough, into which irregularities are pressed, so that the other side of the web is flat as it passes between the front edge 6 and the slip plate. As distinguished from the arrangements shown in FIGS. 1 and 2, the wiping-off blade 6–7 does not bear against the web where it is supported by the roller 2, rather it contacts the web at a position spaced outwardly from the roller as the web passes over the slip plate $2^1$. The separation of the solid support for the web into a rotating roller and a stationary slip plate, as shown in FIG. 3, is one of other suitable modifications of the present invention.

Figure 4:
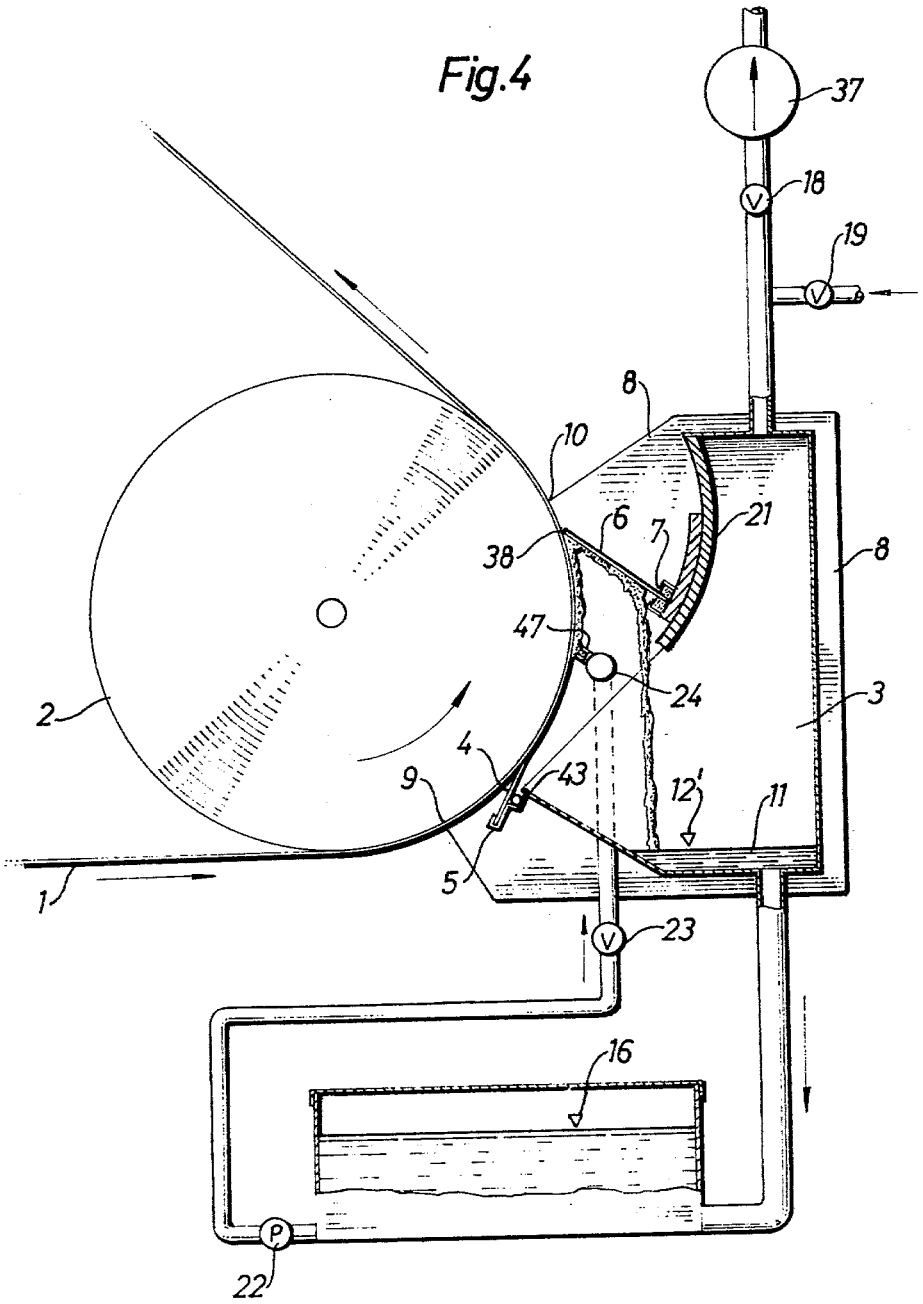
FIG. 4 is another schematic view, similar to FIGS. 1–3, displaying a coating apparatus with yet another embodiment of the present invention.

The apparatus disclosed in FIG. 4 is particularly useful when the coating liquid has a high viscosity. The apparatus differs from that of FIGS. 1–3 in that the coating liquid does not form a pool in contact with the web. The coating fluid is sprayed from the spray tube 24 as film 47 against the web 1. The film 47 accompanies the web 1 up to the point 38 where the blade 6 contacts the web 1. Here excess liquid is wiped off and flows back to the lower portion 11 of the box 3. If the web ruptures the spray tube 24 is preferably rotated so that the film 47 is sprayed directly back to the bottom portion 11 of the box 3. By continuing the circulation of the viscous liquid during periods of web rupture it is possible to avoid changes in viscosity of the liquid. Stagnant liquid usually experiences a change in viscosity.

Test coating has been formed with the apparatus illustrated in FIG. 1. During the testing as described in the examples below, the blade 4–5 was positioned at an angle of 40° to the paper web and the dimension of the blade between its front edge 44 and attachment point 5 was 30 mm and its thickness 0.35 mm, while the comparable dimensions of the wiping-off blade 6 were 85 mm and 0.35 mm, respectively. The curvature of the blades was negligible for a vacuum of up to 1200 mm (the vacuum is defined here and in the following Examples as the height of a column of water, in millimeters).

Comparison coating tests were also performed in a conventional manner. Example 1 shows the results of the variables essential to the invention using pigment coating, performed with a mixture of ordinary composition. In Example 2 the results are compared with a mixture having a high concentration of pigment coated in accordance with the present invention and then in a conventional manner using trailer blades. In Example 3 CMC has been used while in Example 4 a release chemical was employed both having been applied in accordance with the present invention and with a size press.

EXAMPLE 1

Pigment coating using an ordinary coating mixture

A web of paper of the quality MG sulphate was coated with a coating liquid consisting of an aqueous dispersion of 58 percent by weight kaolin, 6.7 percent by weight styrene-butadiene latex, 0.9 percent by weight CMC as thickener, and 0.1 percent by weight dispersing agent.

1.1 Quantity of coating dependent on web speed and angle of contact of the wiper blade (measured at no-load). Viscosity of mixture, 1800 cP, vacuum, 600 mm.

| Angle | 15° | 20° | 25° | 30° | 50° |
|---|---|---|---|---|---|
| Speed m/min | Quantity of coating | | | | |
| 50 | 23 | 13 | 5 | 4 | 3 |
| 100 | | | 6 | 3 | 3 |
| 150 | | | 11 | 3 | 2 |
| 200 | | | 17 | 4 | 3 |
| 250 | | | | 4 | 2 |
| 300 | | | | 5 | 3 |
| 350 | | | | 7 | 3 |

The coating increases with increased web speed and/or reduced blade angle. With a small blade angle the quantity will be stable and reasonably low only if the speed is kept low. With blade angles above 25° the coating becomes gradually lower and independent of the speed.

1.2 Quantity of coating dependent on vacuum and angle of contact of wiper blade. Viscosity of mixture, 1800 cP, web speed 50 m/min.

| Angle | 15° | 25° |
|---|---|---|
| Vacuum mm | Coating quantity g/m² | g/m² |
| 100 | | 8.3 |
| 200 | | 7.6 |
| 300 | | 6.4 |
| 400 | | 5.9 |
| 500 | | 5.2 |
| 600 | 23.4 | 5.0 |
| 800 | 18.4 | 5.0 |
| 1000 | 17.0 | |
| 1200 | 15.5 | |

1.3 Quantity of coating dependent on vacuum and viscosity of mixture. Angle of contact of wiper blade, 15°, web speed, 50 m/min.

| Viscosity Brookfield | 1200 cP | 1800 cP | 2500 cP |
|---|---|---|---|
| Vacuum mm | Coating quantity g/m² | g/m² | g/m² |
| 600 | 20 | 23 | 29 |
| 800 | 16 | 18 | 19 |

Tables 1.2 and 1.3 show, inter alia, that a high coating quantity obtained with a small angle of contact, can to a certain extent be kept constant even with varying web speed (see 1.1) and/or varying viscosity. This can be done by program-regulating the vacuum. This, together with a simple adjustment of the angle of contact of the wiper blade, and the greatly improved chances of using even small blade angles are the characteristic features of the invention.

EXAMPLE 2

Pigment coating using a high pigment concentration

A paper web was coated with a pigment mixture consisting of an aqueous dispersion of 68 percent by weight kaolin, 9 percent by weight styrene-butadiene latex, and 0.1 percent by weight dispersing agent. The coating was made in accordance with the invention. Comparative tests were made with the conventional coating method using a trailer blade, i.e. a single blade 100 mm long and 0.35 mm in thickness, the mixture being applied by roller. Web speed 50 m/min. Blade angles, for the invention 20° and for the trailer blade coating 40°.

The removal of CMC enables a higher pigment concentration to be used as well as an increased quantity of coating, but results in poorer stability of the mixture.

| | Invention | | | | Conventional | | | |
|---|---|---|---|---|---|---|---|---|
| Time min | Conc. % | Visc. cP | Quantity g/m² | Surface Uniformity[x] cm³/min | Conc. % | Visc. cP | Quantity g/m² | Surface Uniformity cm³/min |
| 0 | 68.3 | 2800 | | | 68.3 | 2800 | | |
| 1 | 68.3 | 2800 | 46 | 9 | 68.3 | 2800 | 19 | 26 |
| 5 | | | | | 68.3 | 2800 | 19 | |
| 10 | 68.2 | 2800 | 47 | | 68.4 | 2800 | 19 | |
| 15 | | | | | 68.4 | 2850 | 19 | |
| 20 | 68.3 | 2800 | 50 | | 68.5 | 2950 | 20 | |
| 25 | | | | | 68.5 | 2950 | 21 | |
| 30 | 68.3 | 2800 | 50 | 8 | 68.6 | 3100 | 23 | 19 |
| 40 | 68.3 | 2800 | 50 | 7 | 68.6 | 3150 | 25 | |
| 50 | | | | | 68.8 | 3200 | 26 | 72 |

[x]measured according to Bendtsen.

The table shows that the invention permits copious and uniform coating without the liquid becoming thicker. With the conventional method it was necessary to work with lower coating levels and an acceptable result was then obtained. However, this could not be maintained upon continued operation, which resulted in a thickening of the mixture, increased coating and quite unacceptable scratches.

Another experiment performed in accordance with the invention with the concentration and viscosity the same as in the above experiment but adjusted for a less generous quantity of coating, resulted in a uniform coating of 15–16 g/m$^2$. After 60 minutes in operation no alterations had occurred. The surface uniformity was in this case measured at values between 8–11 cm$^3$/min.

EXAMPLE 3

Coating with CMC

A dense surface is aimed at here with the highest possible CMC concentration. Comparison with conventional coating in size press using two different CMC concentrations. Paper quality: greaseproof-sulphite.

| | Invention | Conventional | |
|---|---|---|---|
| | 1 side | 1 side | 2 sides |
| 2.5 % CMC | | | |
| Pinholes per m$^2$ | 600 | 1900 | 600 |
| Porosity sec | 2.5 | 2.0 | 3.0 |
| 1.25 % CMC | | | |
| Pinholes per m$^2$ | 500 | 2200 | 600 |
| Porosity sec | 2.0 | 2.4 | 6.0 |

The invention results is an approximately equally high quality after coating only one side of the paper as is achieved after coating both sides of the paper in the conventional manner.

EXAMPLE 4

Coating with release chemicals

Here the aim is to obtain a uniform coating concentrated at the surface of the paper. The following results were obtained using a silicon emulsion first in accordance with the invention and then using a conventional size press. The silicon emulsion was made by Rhone-Poulenc, and was used in concentrations of 4, 6 and 8 percent by weight of solids.

The results were measured according to Tappi RC-283. A strip of adhesive tape is pressed against the treated paper for 20 hours at 70° C. and about 200 mN/cm$^2$. When the sample has cooled the delamination force is measured and the average value (a) of 5 measurements is noted. The tape strip drawn off is then pressed against a stainless steel plate by a weight of 1 kg which is rolled slowly over it twice. The delamination force (b) is measured as above.

| | Quantity coated g/m$^2$ | Delamination force a pond | b pond | b/a |
|---|---|---|---|---|
| The invention | 0.42 | 10 | 220 | 22 |
| | 0.58 | 10 | 240 | 24 |
| | 0.64 | 10 | 210 | 21 |
| Conventional | 0.35 | 60 | 110 | 1.8 |
| | 0.50 | 45 | 150 | 3.3 |
| | 0.65 | 35 | 170 | 4.8 |

Irrespective the quantity of coating, it is considerably easier (a) to pull the tape off the paper which has been treated in accordance with the invention. Less glue is also removed from the adhesive tape strip and this is consequently more difficult (b) to pull from the stainless steel plate. The release effect is infinitely better when the new method is used.

By maintaining the coating liquid within a closed chamber, the present invention aims to reduce the pollution of the coating liquid from the surroundings and also the pollution of the surroundings by the coating liquid. The results and experience gained from the test runs show that it is possible, using the present invention, to obtain the reduction in the pollution mentioned above. Furthermore, the expected improvement is quality has been surprisingly greater, as shown by the examples. Coating with totally different liquids for different purposes has resulted in coatings of superior quality even with small quantities of coating and in surfaces of superior smoothness even when large quantities of coating are applied and when liquid having high consistencies and/or high pigment concentration are used. The possibilities of regulating the coating quantities and keeping them constant have been radically improved.

The reason for these unexpectedly good results has not been fully determined, however, it is obvious that for most purposes it is desirable to use small quantities of coating, concentrated at the surface of the paper. The coating procedure permits highly viscous liquids to be pressed very close to the desired point near the coating blade. The liquids can run down to the blade due to the relatively great differences in level inside the box, without being disturbed by the pressure from the liquid pump. This, together with the smoothing and compressing action on the web, in combination with the vacuum conditions maintained, probably insures that the coating is satisfactorily placed in contact with the surface of the paper and, at the same time, the solvent is prevented from penetrating into the paper in an unsuitable or, in certain cases, even a damaging manner. Since the wiping-off action can be carried out with a relatively small blade angle, satisfactory regulation and little disturbance from the surroundings, the total result is so good that it can be designated as synergetic.

Another valuable feature of the present invention is the sharp lateral limitation of the coating effected on the web or strip of material. This feature enables the web to be coated in several strips, well defined from one another, with the separate strips being applied by using separate boxes or a single box divided by partitions with separate blades extending between the partitions.

The method can be employed for melts or other coating liquids and webs than those mentioned in the examples. The apparatus and its use relative to the web can also be modified, for example, by placing the web against a non-curved surface or a soft surface, using different blade lengths, thickness and angle of contact, producing contact by means of gas pressure from the outside instead of vacuum from the inside, or regulating the level of the liquid in some way other than by overflow and return of the liquid. It is also possible to regulate the contact of the blade by maintaining an overpressure inside the box and at the same time regulating the contact of the wiper blade by maintaining an even higher pressure on the outside. The web can also be coated on both sides by placing two boxes symmetrically one on each side of the web, similar variations are, of course, within the scope of the invention.

While specific embodiments of the invention have been shown and described in detail to illustrate the application of the inventive principles, it will be understood that the invention may be embodied otherwise without departing from such principles.

I claim:

1. Apparatus for continuously coating a strip of material, such as a web of paper, with a liquid, comprising a support member over which the strip material is passed in the coating operation, wall means forming a box having at least one open side, said box positioned adjacent said support member so that a portion of the periphery of said support member is located within the range of the open side in said box, means for supplying a coating liquid into said box so that the strip of material passing over said support member contacts the liquid therein, a first flexible wiping blade positioned within said box and extending into the range of the open side of said box for providing a wiping action on the strip of material following the completion of its passage in contact with the coating liquid, said first wiping blade having a supported edge spaced from said support member and a free edge spaced from and opposite said supported edge with said free edge being in line contact with the strip of material passing over said support member to effect said wiping action the combination of said wall means, said support member for the strip material and said first wiping blade providing a closed chamber containing the coating liquid, and means in communication with said closed chamber for providing a partial vacuum within said closed chamber as compared to higher pressure conditions exterior of said closed chamber, said first wiping blade extending between said free edge and said supported edge positioned to be exposed to and flexibly responsive to the partial vacuum within said closed chamber and the higher pressure conditions exterior of said closed chamber, and means for varying the angle between said first wiping blade and the strip of material, and said means for varying the angle between said first blade and the strip of material comprises a portion of the closed chamber wall having the shape of a circular arc, and a part secured to said supported edge of said first blade spaced from said support member and having the shape of a circular arc complementary to and movably mounted on said arcuate wall portion, and means disposed within the chamber defining a pivotably adjustable spillway for regulating the level of the coating liquid therein, and further means comprised of a bottom portion of the chamber wall providing a preliminary smoothing and compressing action on the strip, said further means comprising a flexible blade member disposed in a biased contact with said strip as it commences its passage through the closed chamber.

2. Apparatus, as set forth in claim 1 including means for exerting a torque on said second blade at a position spaced from its linear edge contact with the strip of material supported on said support member for holding it against said support member.

3. Apparatus, as set forth in claim 2, wherein said means for exerting a torque on said second blade comprises a channel located at a portion of said second blade spaced from said support member and a tube having a regulable hydraulic pressure therein for adjustably controlling the torque acting on said second blade.

4. Apparatus, as set forth in claim 2, wherein said support member comprises a cylindrically shaped roller having its axis arranged horizontally and the location of contact of said second blade with the strip of material supported on said support member positioned below said first wiping blade.

5. Apparatus, as set forth in claim 1, wherein said wall means comprises stationary side walls disposed in spaced relationship to said support member and movably positionable side walls mounted on said fixed side walls and arranged to be positioned in sealing contact with the strip of material supported on said support member.

6. Apparatus for continuously coating a strip of material, such as a web of paper, with a liquid, comprising a support member over which the strip of material is passed in the coating operation, wall means forming a box having at least one open side, said box positioned adjacent said support member so that a portion of the periphery of said support member is located within the range of the open side in said box, means for supplying a coating liquid into said box for providing a body of the coating liquid therein within the range of the open side of said box so that the strip of material passing over said support member contacts the body of the coating liquid therein, a flexible wiping blade positioned in said box and adapted to provide a wiping-off action on the strip of material following the completion of its passage in contact with the coating liquid said wiping blade having a supported edge spaced from said support member and a free edge spaced from and opposite said supported edge with said free edge being in line contact with the strip of material passing over said support member whereby to effect said action, the combination of said wall means, said support member for the strip material and said wiping blade providing a closed chamber containing the coating liquid, means for varying the angle between said wiping blade and the strip of material, means in communication with said closed chamber for providing a partial vacuum within said closed chamber as compared to a higher air pressure on the exterior of said closed chamber whereby, to influence said flexible wiping blade contact with the coated strip and said means for varying the angle between said wiper blade and the strip of material comprises a portion of the closed chamber wall having the shape of a circular arc, and a part secured to said supported edge of said wiper blade spaced from said support member and having the shape of a circular arc complementary to and movably mounted on said base arcuate wall portion, and means disposed within the chamber defining a pivotably adjustable spillway for regulating the level of the coating liquid therein, and further means comprised of a bottom portion of the chamber wall providing a preliminary smoothing and compressing action on the strip, said further means comprising a flexible blade member disposed in a biased contact with said strip as it commences its passage through the closed chamber.

7. Apparatus for continuously coating a strip of material, such as a web of paper, with a liquid, comprising a support member over which the strip of material is passed in the coating operation, wall means forming a box having at least one open side, said box positioned adjacent said support member so that a portion of the periphery of said support member is located within the range of the open side in said box, means for supplying a coating liquid into the box so that the strip of material passing over said support member contacts the liquid therein, a flexible wiping blade positioned within said box and extending into the range of the open side of said box for providing a wiping action on the strip of material following the completion of its passage in contact with the coating liquid, said wiping blade having a supported edge spaced from said support member and a free edge spaced from and opposite said supported edge with said free edge being in line contact with the strip of material whereby to effect said action, the combination of said wall means, said support member for the strip material and said wiping blade providing a closed chamber containing the coating liquid, and means in communication with said closed chamber for providing differential pressure conditions between the interior of said closed chamber and the exterior of said closed chamber with lower pressure conditions within the interior of said closed chamber, said wiping blade arranged to be exposed to the differential pressure conditions for biasing said wiping blade into contact with the strip material as it passes over said support member, and said means for varying the angle between said wiper blade and the strip of material comprises a portion of the closed chamber wall having the shape of a circular arc, and a part secured to said supported edge of said wiper blade spaced from said support member and having the shape of a circular arc complementary to and movably mounted on said base arcuate wall portion, and means disposed within the chamber defining a pivotably adjustable spillway for regulating the level of the coating liquid therein, and further means comprised of a bottom portion of the chamber wall providing a preliminary smoothing and compressing action on the strip, said further means comprising a flexible blade member disposed in a biased contact with said strip as it commences its passage through the closed chamber.

8. Apparatus, as set forth in claim 7, wherein said contact of the second plate member is at a linear plate edge.

9. Apparatus, as set forth in claim 7, wherein said means for regulating the level of the coating liquid comprises a pivotally mounted spreader pipe arranged to supply the coating liquid into said closed chamber, and a pair of flanges secured to and extending from opposite sides of said pipe with one of said flanges arranged to form a seal with the lower surface of said closed chamber and the other one of said flanges arranged to form a spillway defining the upper level of the liquid within said closed chamber.

10. Apparatus, as set forth in claim 7, wherein the front edge of the second blade extends beyond a sealing contact thereof with the strip on said support member and in the opposite direction to which the strip of material passes over said support member as it moves through said closed chamber.

11. Apparatus, as set forth in claim 10, wherein said wall means includes a stationary slip plate having one edge adjacent said support member with said slip plate extending outwardly therefrom above the liquid level within said closed chamber and said slip plate defining an enclosing part of said closed chamber, so that after the strip of material supported on said support member passes upwardly above the level of the coating liquid it travels along and in contact with the surface of said slip plate until it leaves said closed chamber, and said wiping blade contacting the strip of material as it passes over said slip plate.

12. Apparatus, as set forth in claim 11, wherein said chamber forms a sump for receiving the coating liquid flowing over said spillway.

* * * * *